US006830034B2

(12) United States Patent
Engelmeyer et al.

(10) Patent No.: US 6,830,034 B2
(45) Date of Patent: Dec. 14, 2004

(54) FUEL INJECTOR AND FUEL RAIL CHECK VALVES

(75) Inventors: Scott A. Engelmeyer, Yorktown, VA (US); Dean Spiers, Yorktown, VA (US); John Bierstaker, Yorktown, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 214 days.

(21) Appl. No.: 09/755,089

(22) Filed: Jan. 8, 2001

(65) Prior Publication Data

US 2001/0050073 A1 Dec. 13, 2001

Related U.S. Application Data

(60) Provisional application No. 60/180,694, filed on Feb. 7, 2000.

(51) Int. Cl.[7] ..... F02M 37/04

(52) U.S. Cl. ..... 123/470; 123/456; 123/198 D; 239/569

(58) Field of Search ..... 123/470, 469, 123/468, 456, 198 D, 467; 239/600, 569, 585.1, 583; 251/149.6

(56) References Cited

U.S. PATENT DOCUMENTS

| | | | | | |
|---|---|---|---|---|---|
| 3,081,758 | A | | 3/1963 | May | 123/139 |
| 4,197,996 | A | | 4/1980 | Giardini | 239/87 |
| 4,306,680 | A | | 12/1981 | Smith | 239/87 |
| 4,373,671 | A | | 2/1983 | Giardini | 239/585 |
| 4,427,151 | A | | 1/1984 | Trenne | 239/87 |
| 4,539,959 | A | * | 9/1985 | Williams | 123/456 |
| 4,964,391 | A | * | 10/1990 | Hoover | 123/510 |
| 5,085,189 | A | * | 2/1992 | Huang et al. | 123/275 |
| 5,242,117 | A | * | 9/1993 | D'Agostino et al. | 239/533.2 |
| 5,511,528 | A | * | 4/1996 | Iwanaga et al. | 123/467 |
| 5,603,302 | A | | 2/1997 | Minagawa et al. | 123/456 |
| 5,775,305 | A | | 7/1998 | Bolger | 123/497 |
| 5,887,799 | A | | 3/1999 | Smith | 239/585.1 |
| 5,934,253 | A | * | 8/1999 | Kojima et al. | 123/470 |
| 5,988,213 | A | * | 11/1999 | Yoshioka | 137/590 |
| 6,000,628 | A | | 12/1999 | Lorraine | 239/87 |
| 6,003,790 | A | * | 12/1999 | Fly | 239/533.9 |
| 6,223,727 | B1 | * | 5/2001 | Tahara et al. | 123/470 |
| 6,263,863 | B1 | * | 7/2001 | Giovannini et al. | 123/470 |

* cited by examiner

*Primary Examiner*—Carl S. Miller

(57) ABSTRACT

A fuel injector with a neck at an upstream end and a downstream end located at a distal end from the upstream end, a fuel channel extending from the upstream end to the downstream end and defining a substantially longitudinal axis, and a check valve located in the fuel channel proximate the upstream end; and a fuel rail with a housing defining an opening having a substantially longitudinal axis passing therethrough, and a one-way flow inhibitor is located in the opening. When removing the fuel injector from the fuel rail, reducing leaks by biasing a plunger of the check valve against a seat of the check valve in the fuel injector and biasing a plunger of the one-way flow inhibitor against a seat of the one-way flow inhibitor in the fuel rail.

20 Claims, 6 Drawing Sheets

FUEL INJECTOR AND FUEL RAIL CHECK VALVES

REFERENCE TO RELATED APPLICATION AND PRIORITY CLAIM

This application expressly claims the benefit of the earlier filing date and right of priority from the following patent application: U.S. Provisional Application Ser. No. 60/180,694, filed on Feb. 7, 2000 in the name of Scott A. Engelmeyer, Dean Spiers, and John Bierstaker and entitled "Fuel Injector and Fuel Rail Check Valves." The entirety of that earlier-filed, copending provisional patent application is hereby expressly incorporated herein by reference.

FIELD OF THE INVENTION

The present invention relates to the field of fuel injectors and fuel rails, and more particularly to reducing leaking in fuel rail and fuel injector assemblies.

BACKGROUND OF THE INVENTION

Customer standards require that no fuel be spilled from a fuel rail/fuel injector interface when servicing a gasoline fuel system. The fuel system includes the fuel injector connected to the fuel rail, with both the fuel injector and the fuel rail containing relatively large volumes of liquid fuel. In the past, this requirement was achieved on MPI fuel systems by rigidly attaching the fuel injector to the fuel rail by means of a steel retaining clip. The steel retaining clips are designed so that under the worst case, such as an automobile collision, the fuel injector and the fuel rail would not become disconnected from one another, allowing fuel spillage.

However, with the new HPDI (High Pressure Direct Injection) system, the conditions for fuel system removal have greatly changed. A phenomenon known as "injector coking" occurs, which is found only in HPDI systems. This phenomenon is characterized by carbon deposits around the tip of the injector in the cylinder head. These deposits form a very strong bond between the injector and the cylinder head into which the injector is inserted, making removal of the injector from the cylinder head impossible, unless the carbon bond is broken first. In order to remove an injector that has been "coked" into the cylinder head, the injector must first be disconnected from the fuel rail and then rotated approximately fifteen degrees to break the carbon bond. Upon breaking the carbon bond, the injector can easily be removed from the engine. However, once the injector is disconnected from the fuel rail, fuel can spill from either the fuel rail, the injector, or both, as there are no mechanisms in either the fuel rail or the injector to prevent such unwanted flow.

It would be beneficial to provide a fuel rail and/or a fuel injector that does not leak fuel or minimizes fuel leakage when the fuel rail and injector are disconnected from each other.

SUMMARY OF THE INVENTION

The present invention provides a fuel injector with a neck at an upstream end and a downstream end located at a distal end from the upstream end. A fuel channel extends from the upstream end to the downstream end and defines a substantially longitudinal axis. A check valve is located in the fuel channel proximate the upstream end.

The present invention also provides a fuel rail with a housing defining an opening having a substantially longitudinal axis passing therethrough. A one-way flow inhibitor is located in the opening.

The present invention provides for a method of reducing leaks when a fuel injector is removed from a housing. This method includes: providing a fuel channel in the fuel injector communicating with an opening in the housing; removing the fuel injector from the housing; biasing the first plunger against the first seat; and substantially retaining any unpressurized fuel in the fuel injector. The fuel channel of the fuel injector has a first check valve with a first plunger and a first seat.

The present invention also provides for another method of reducing leaks when a fuel injector is removed from a housing. This method includes: providing a fuel channel in the fuel injector communicating with an opening in the housing; removing the fuel injector from the housing; and substantially retaining any unpressurized fuel in the fuel injector. The fuel channel of the fuel injector has a first one-way flow inhibitor with a membrane extending across the fuel channel and a seal connecting the membrane of the fuel injector to a side wall of the fuel channel.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain features of the invention. In the drawings.

DETAILED DESCRIPTION OF THE PREFERRED EMBODIMENTS

Figure 1:
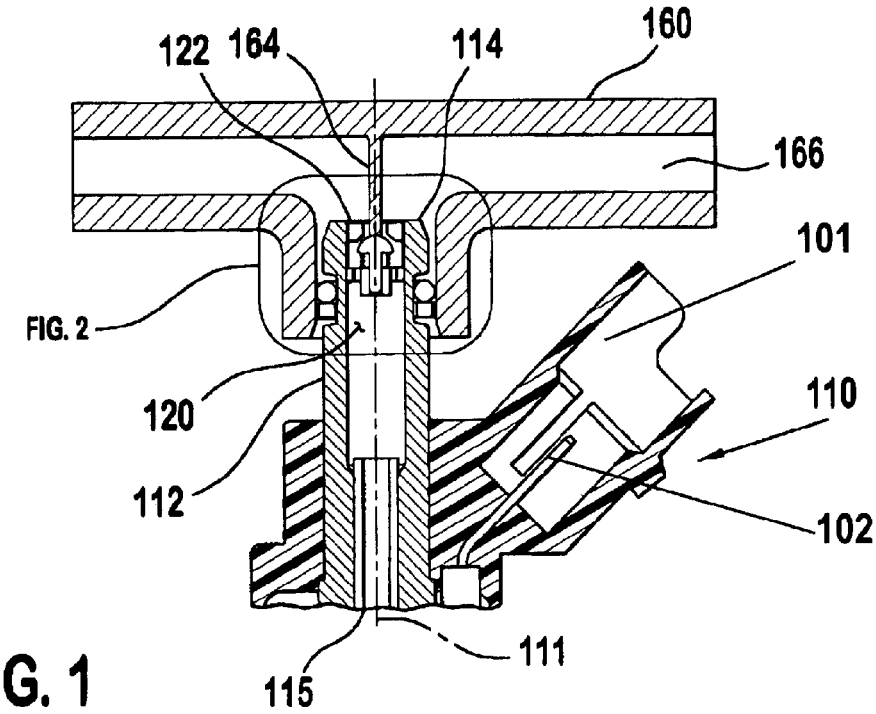
FIG. 1 is a side view, in section, of a fuel injector connected to a fuel rail in accordance with a first embodiment of the present invention.
Figure 2:
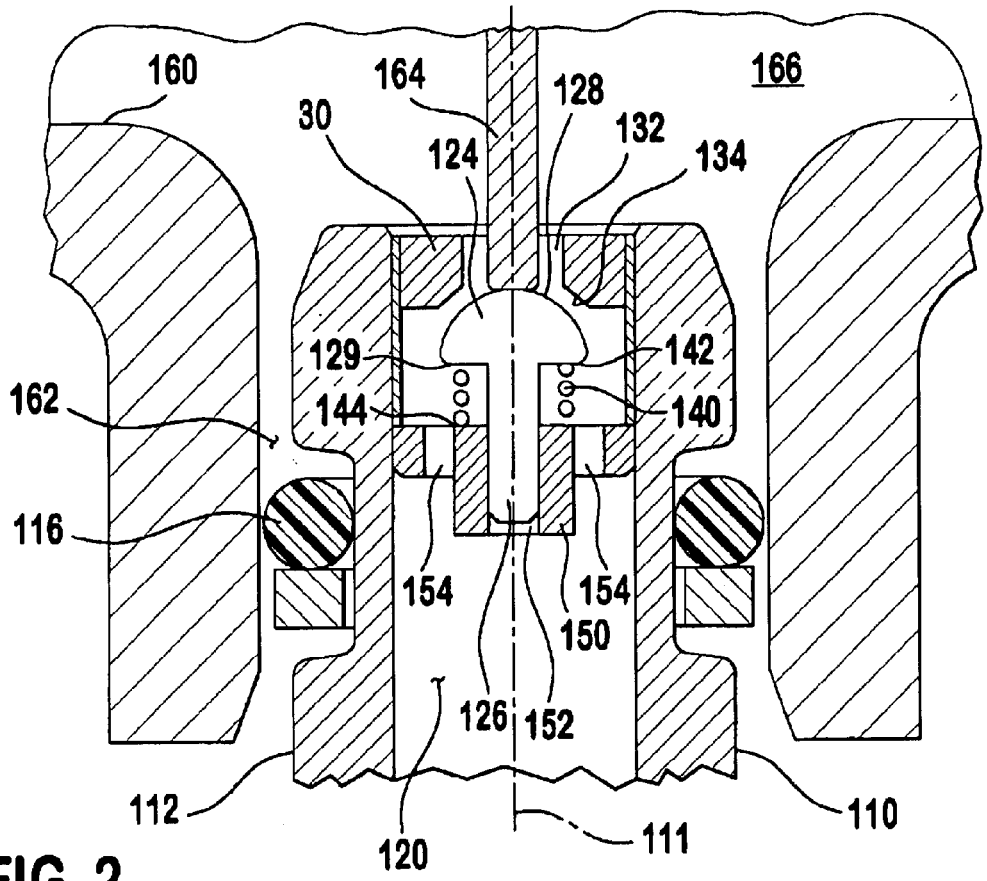
FIG. 2 is an enlarged view of the fuel injector connected to the fuel rail as shown in FIG. 1.

In the drawings, like numerals are used to indicate like elements throughout. FIGS. 1 and 2 disclose a first embodiment of a fuel injector 110 connected to a housing, or fuel rail 160. The fuel injector 110 includes a mechanically openable check valve 122, which is opened upon installation of the fuel injector 110 into the fuel rail 160.

The fuel injector 110 includes a longitudinal axis 111 extending therethrough. The fuel injector 110 also includes a neck 112 at an upstream end 114 of the fuel injector 110, which is sized to fit into an opening 162 in the fuel rail 160. A body 100 surrounds an aperture 101 and receives an electrical connector 102 to provide electrical signals to a valve actuator (partially shown). A downstream end 115 of the injector 110 is located at a distal end of the injector 110 from the upstream end 114. As used herein, the term "upstream" is defined to mean a direction toward the top of the figure which is referenced and the term "downstream" is defined to mean a direction toward the bottom of the figure which is referenced. An o-ring 116 is located on an outer perimeter of the neck 112 such that, when the fuel injector 110 is inserted into the fuel rail 160, the o-ring 116 seals any space between the outer perimeter of the neck 112 and the opening 162, preventing fuel in the fuel rail 160 from leaking out.

The injector 110 includes a fuel channel 120, which extends from the upstream end 114 to the downstream end 115 and generally defines the longitudinal axis 111 of the injector 110. A valve 122 is located in the channel 120, proximate to the upstream end 114 of the injector 110. The valve 122 includes a plunger 124, a seat 130, a biasing member 140, which biases the plunger 124 toward the seat 130, and a guide 150. The plunger 124 includes a stem 126, which reciprocates in a central opening 152 in the guide 150 along the longitudinal axis 111. The plunger 124 also includes a generally bulbous head 128 connected to the upstream end of the stem 126. A downstream end of the head 128 includes a generally flat annular ledge 129 against which an upstream end 142 of the biasing member 140, preferably a helical spring, is biased. A downstream end 144 of the biasing member 140 is biased against the guide 150. Although a helical spring is preferred, those skilled in the art will recognize that other biasing members can be used.

The seat 130 includes a longitudinal seat channel 132, which extends therethrough along the longitudinal axis 111. The seat 130 also includes a generally annular beveled seating surface 134 which extends downstream and away from the longitudinal axis 111. In an uninstalled condition (not shown), the head 128 is biased by the biasing member 140 against the seating surface 134, shutting off fuel flow from the seat channel 132 downstream to the fuel channel 120.

In an installed condition, shown in FIG. 2, a fuel rail projection 164 engages the head 128, forcing the head 128 away from the seating surface 134 and toward the guide 150. In this condition, the fuel channel 120 is in fluid communication with the opening 162 and the fuel rail channel 166, allowing pressurized fuel in the fuel rail channel 166 to flow past the valve 122, through a plurality of radially spaced openings 154 in the guide 150, and to the fuel channel 120 for injection. As shown in FIG. 1, the fuel rail projection 164 is preferably in a unitary construction with the fuel rail 160 (i.e. cast together). Alternatively, a fuel rail 160 without the projection 164 cast with the fuel rail 160 can be installed by drilling an opening in the fuel rail 160 at the desired location, inserting a projection into the opening, and fixedly connecting the projection to the fuel rail 160, such as by welding or brazing.

When the injector 110 is separated from the fuel rail 160, the projection 164 relieves any biasing action against the head 128, allowing the biasing member 140 to bias the plunger 124, and thus the head 128, against the seating surface 134 of the valve seat 130, preventing any fuel in the injector 110 from leaking from the upstream end 114 of the injector 110.

Figure 3:
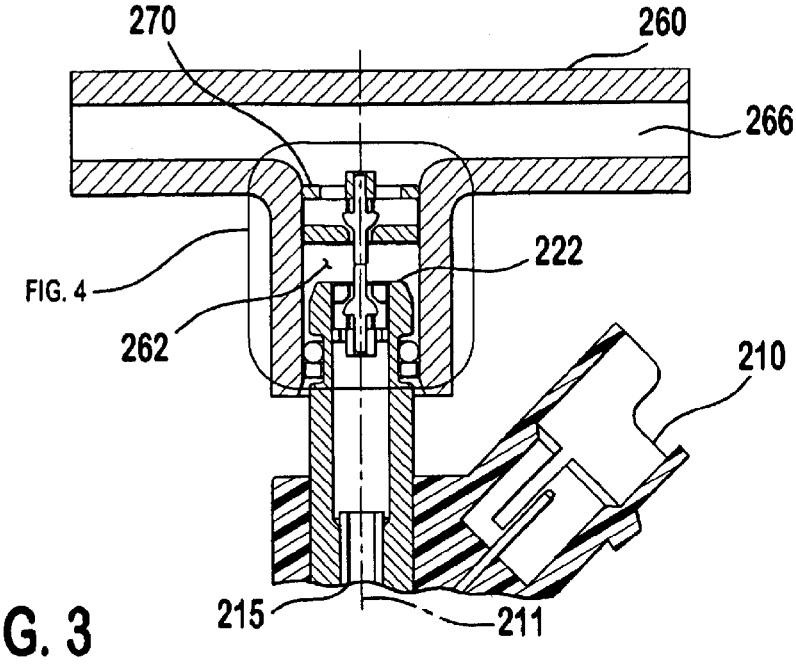
FIG. 3 is a side view, in section, of a fuel injector connected to a fuel rail in accordance with a second embodiment of the present invention.
Figure 4:
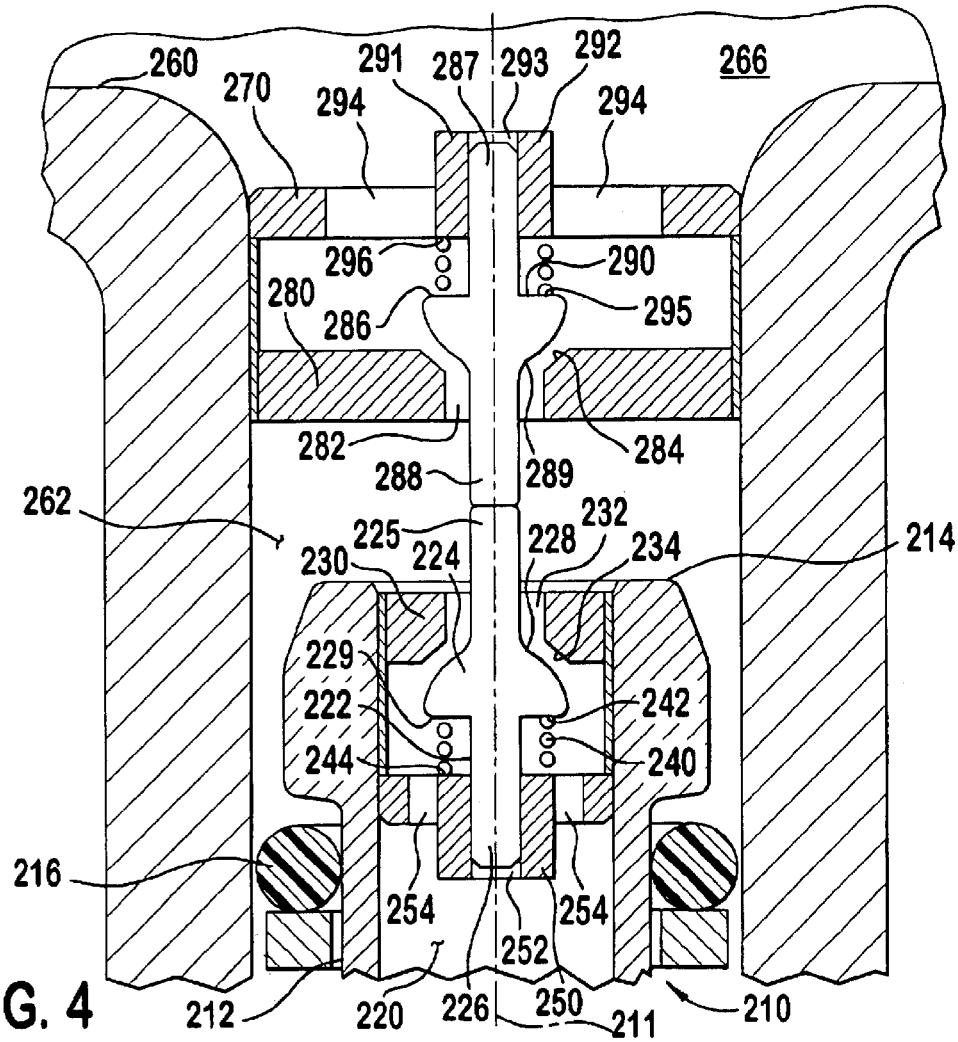
FIG. 4 is an enlarged view of the fuel injector connected to the fuel rail as shown in FIG. 3.

A second embodiment of the present invention, shown in FIGS. 3 and 4, depicts a fuel injector 210 inserted into a fuel rail 260. The fuel rail 260 differs from the fuel rail 160 in the first embodiment in that the fuel rail 260 includes a second check valve 270, which seals fuel in the fuel rail 260 and prevents fuel from leaking from the fuel rail 260 when the injector 210 is removed from the fuel rail 260, in an opening 262 in the fuel rail 260.

The fuel injector 210 includes a longitudinal axis 211 extending therethrough. The fuel injector 210 also includes a neck 212 at an upstream end 214 of the fuel injector 210 which is sized to fit into the opening 262 in the fuel rail 260. A downstream end 215 of the injector 210 is located at a distal end of the injector 210 from the upstream end 214. An o-ring 216 is located on an outer perimeter of the neck 212 such that when the fuel injector 210 is inserted into the fuel rail 260, the o-ring 216 seals any space between the outer perimeter of the neck 212 and the opening 262, preventing fuel in the fuel rail 260 from leaking out.

The injector 210 includes a fuel channel 220, which extends from the upstream end 214 to the downstream end 215 and generally defines the longitudinal axis 211 of the injector 210. A valve 222 is located in the channel 220, proximate to the upstream end 214 of the injector 210. The valve 222 includes a plunger 224, a seat 230, a biasing member 240, which biases the plunger 224 toward the seat 230, and a guide 250. The plunger 224 includes a stem 226, which reciprocates in a central opening 252 in the guide 250 along the longitudinal axis 211. The plunger 224 also includes a generally bulbous head 228 connected to the upstream end of the stem 226. The upstream side of the head 228 includes an engagement stem 225 for reasons that will be discussed. A downstream end of the head 228 includes a generally flat annular ledge 229 against which an upstream end 242 of the biasing member 240, preferably a helical spring, is biased. A downstream end 244 of the biasing member 240 is biased against the guide 250. Although a helical spring is preferred, those skilled in the art will recognize that other biasing members can be used.

The seat 230 includes a longitudinal seat channel 232, which extends therethrough along the longitudinal axis 211. The seat 230 also includes a generally annular beveled seating surface 234, which extends downstream and away from the longitudinal axis 211.

The second valve 270 is located in the opening 262 in the fuel rail 260, with sufficient clearance in the opening 262 so that the injector 210 can be fully inserted. The valve 270 includes a plunger 286, a seat 280, a biasing member 291, which biases the plunger 286 toward the seat 280, and a guide 292. The plunger 286 includes a stem 287, which reciprocates in a central opening 293 in the guide 292 along the longitudinal axis 211. The plunger 286 also includes a generally bulbous head 289 connected to the downstream end of the stem 287. The downstream side of the head 289 includes an engagement stem 288 for reasons that will be discussed. An upstream side of the head 289 includes a generally flat annular ledge 290 against which a downstream end 295 of the biasing member 291, preferably a helical spring, is biased. An upstream end 296 of the biasing member 291 is biased against the guide 292. Although a helical spring is preferred, those skilled in the art will recognize that other biasing members can be used.

The seat 280 includes a longitudinal seat channel 282, which extends therethrough along the longitudinal axis 211. The seat 280 also includes a generally annular beveled seating surface 284 which extends downstream and toward the longitudinal axis 211.

In an uninstalled condition (not shown), or when the fuel injector 210 is removed from the fuel rail 260, the injector valve 222 is closed. The plunger 224 is biased by the biasing member 240 against the seating surface 234, shutting off fuel flow from the seat channel 232 downstream to the fuel channel 220. The fuel rail valve 270 is also closed. The plunger 286 is biased by the biasing member 291 against the seating surface 284, shutting off flow from the fuel channel 266 to the seat channel 282. Consequently, any unpressurized fuel in the fuel rail 260 and fuel injector 210 is substantially retained.

In an installed condition, the engagement stem 288 in the valve 270 engages the engagement stem 225 in the valve 222, forcing the plunger 286 away from the seating surface 284 and toward the guide 292. Simultaneously, the plunger 224 is forced from the seating surface 234 and toward the guide 256. In this condition, the fuel channel 220 is in fluid communication with the fuel rail channel 266, allowing pressurized fuel in the fuel rail channel 266 to flow through the seat channel 222, through a plurality of radially spaced openings 294, 254 in the guides 292, 250, respectively, and to the fuel channel 220 for injection. Although, in this preferred embodiment, an engagement stem 225, 288 is incorporated in each of the plungers 224, 286, those skilled in the art will recognize that only one stem 225 or 288 needs to be used, as long as the stem 225 or 288 is sufficiently long to engage the other plunger 224 or 286 to open both plungers 224, 286 in the installed condition.

Figure 5:
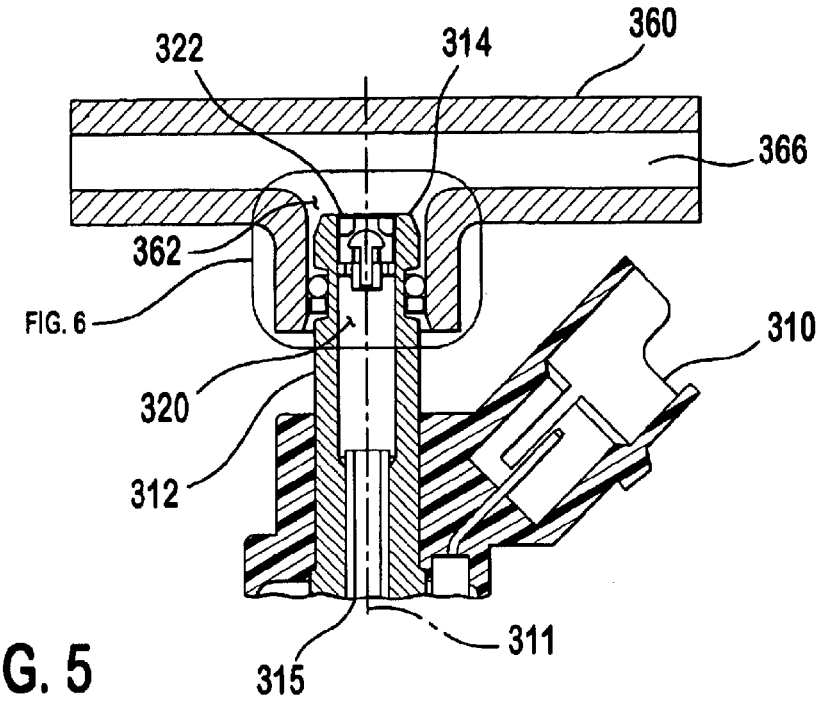
FIG. 5 is a side view, in section, of a fuel injector connected to a fuel rail in accordance with a third embodiment of the present invention.
Figure 6:
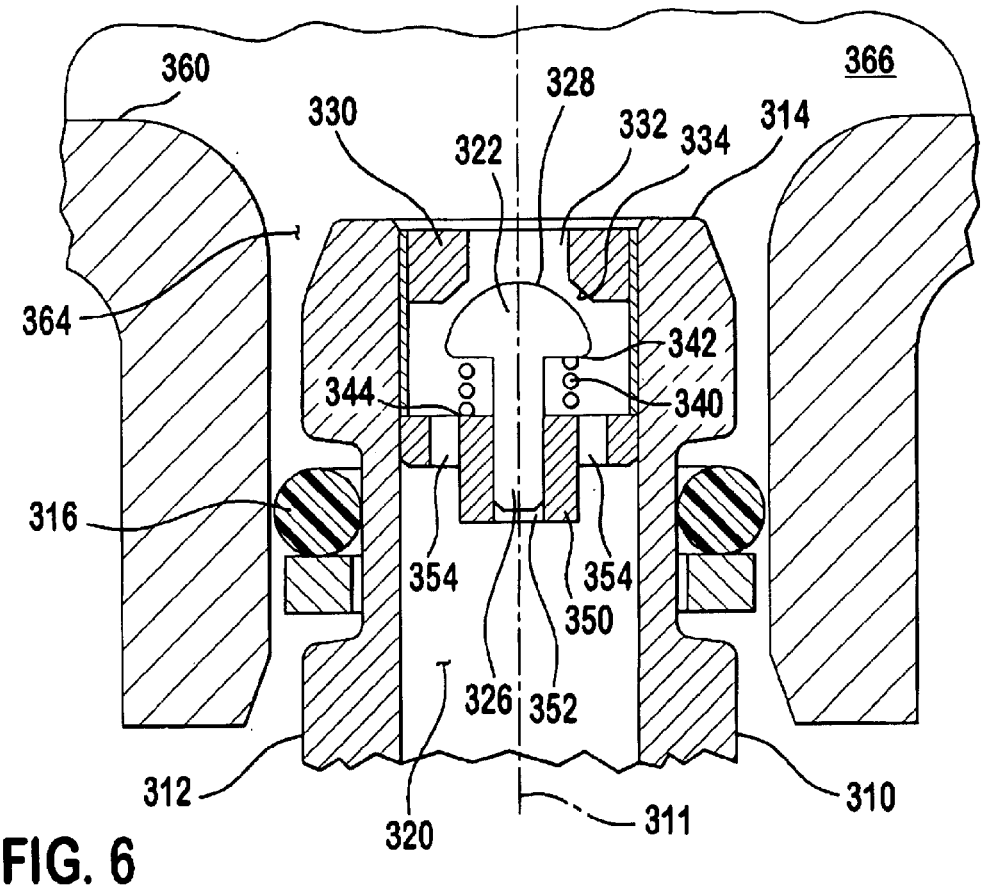
FIG. 6 is an enlarged view of the fuel injector connected to the fuel rail as shown in FIG. 5.

A third embodiment of the present invention is shown as a valve 310 in FIGS. 5 and 6. The third embodiment is similar to the first two embodiments with the exception that the third embodiment does not include a mechanical device to open a check valve 322 in the injector 310 when the injector 310 is installed in the fuel rail 360. The third embodiment uses the hydraulic force of the fuel in the fuel rail 360 to force the check valve 322 to an open position, allowing fuel to flow from the fuel rail 360 to the injector 310.

The fuel injector 310 includes a longitudinal axis 311 extending therethrough. The fuel injector 310 also includes a neck 312 at an upstream end 314 of the fuel injector 310, which is sized to fit into an opening 362 in the fuel rail 360. A downstream end 315 of the injector 310 is located at a distal end of the injector 310 from the upstream end 314. An o-ring 316 is located on an outer perimeter of the neck 312 such that when the fuel injector 310 is inserted into the fuel rail 360, the o-ring 316 seals any space between the outer perimeter of the neck 312 and the opening 362, preventing fuel in the fuel rail 360 from leaking out.

The injector 310 includes a fuel channel 320, which extends from the upstream end 314 to the downstream end 315 and generally defines the longitudinal axis 311 of the injector 310. A valve 322 is located in the upstream end of the channel 320, proximate to the upstream end 314 of the injector 310. The valve 322 includes a plunger 324, a seat 330, a biasing member 340, which biases the plunger 324 toward the seat 330, and a guide 350. The plunger 324 includes a stem 326, which reciprocates in a central opening 352 in the guide 350 along the longitudinal axis 311. The plunger 324 also includes a generally bulbous head 328 connected to the upstream end of the stem 326. A downstream end of the head 328 includes a generally flat annular ledge 329 against which an upstream end 342 of the biasing member 340, preferably a helical spring, is biased. A downstream end 344 of the biasing member 340 is biased against the guide 350. Although a helical spring is preferred, those skilled in the art will recognize that other biasing members can be used.

The seat 330 includes a longitudinal seat channel 332, which extends therethrough along the longitudinal axis 311. The seat 330 also includes a generally annular beveled seating surface 334, which extends downstream and away from the longitudinal axis 311. In an uninstalled condition (not shown), the head 328 is biased by the biasing member 340 against the seating surface 334, shutting off fuel flow from the seat channel 332 downstream to the fuel channel 320. In an installed but unpressurized condition, the head 328 remains biased against the seating surface 334. However, when the fuel rail channel 366 is pressurized with fuel, the pressurized fuel forces against the head 328 and overcomes the force of the biasing member 340, separating the head 328 from the seating surface 334. In this condition, the fuel channel 320 is in fluid communication with the fuel rail channel 366, allowing pressurized fuel in the fuel rail channel 366 to flow through the seat channel 322, through a plurality of radially spaced openings 354 in the guide 350, and to the fuel channel 320 for injection.

When the pressure of the fuel in the fuel channel 366 decreases to a force less than the force exerted by the biasing member 340 against the plunger 324, the biasing member 340 biases the plunger 324, and thus the head 328, against the seating surface 334 of the valve seat 330, preventing any fuel in the injector 310 from leaking from the upstream end 314 of the injector 310.

Figure 7:
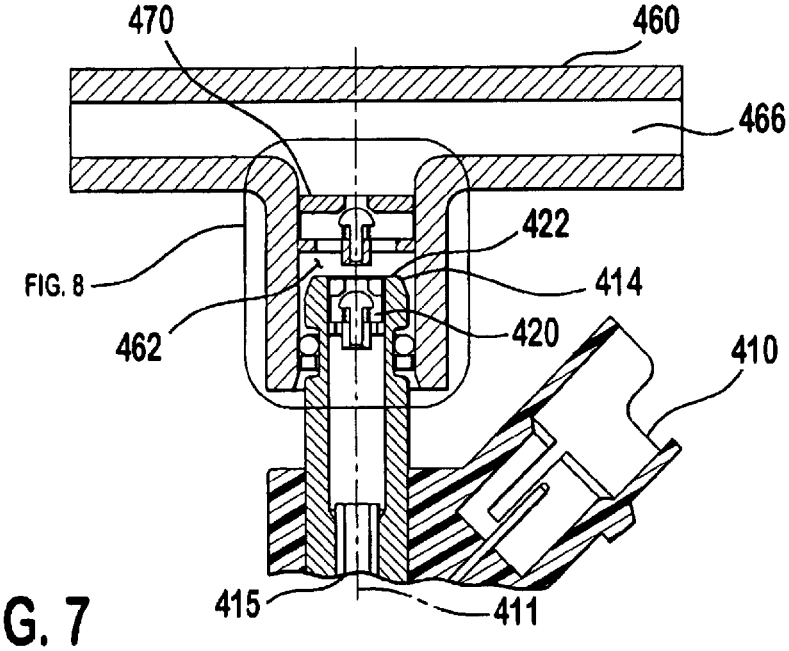
FIG. 7 is a side view, in section, of a fuel injector connected to a fuel rail in accordance with a fourth embodiment of the present invention.
Figure 8:
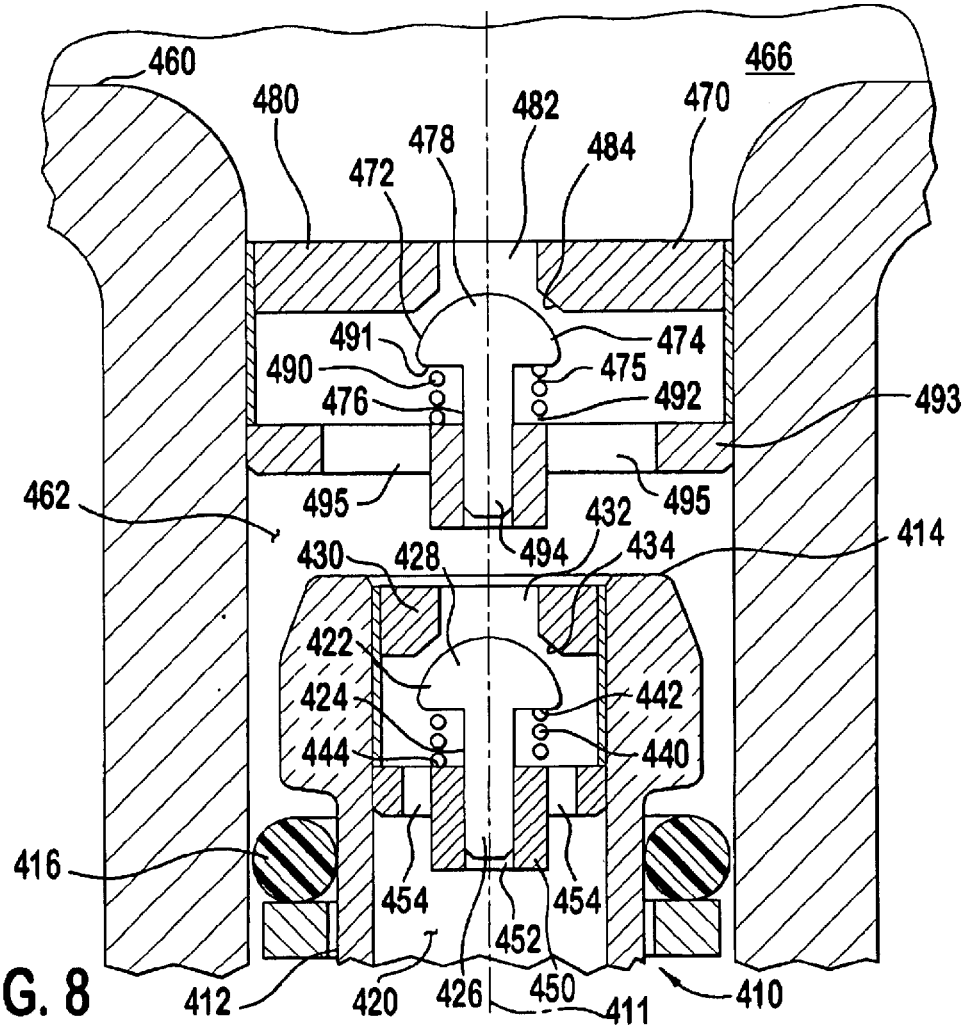
FIG. 8 is an enlarged view of the fuel injector connected to the fuel rail as shown in FIG. 7.

A fourth embodiment, shown in FIGS. 7 and 8, is similar to the third embodiment, with an added feature of a check valve 470 installed in the opening 462 of the fuel rail 460. The check valve 470 prevents any residual fuel in the fuel rail 460 from leaking out of the fuel rail 460 when the injector 410 is separated from the fuel rail 460. The fourth embodiment uses the hydraulic force of the fuel in the fuel rail 460 to force the check valve 422 in the injector 410 and the check valve 470 in the opening 462 to an open position, allowing fuel to flow from the fuel rail 460 to the injector 410.

The fuel injector 410 includes a longitudinal axis 411 extending therethrough. The fuel injector 410 also includes a neck 412 at an upstream end 414 of the fuel injector 410, which is sized to fit into an opening 462 in the fuel rail 460. A downstream end 415 of the injector 410 is located at a distal end of the injector 410 from the upstream end 414. An o-ring 416 is located on an outer perimeter of the neck 412 such that when the fuel injector 410 is inserted into the fuel rail 460, the o-ring 416 seals any space between the outer perimeter of the neck 412 and the opening 462, preventing fuel in the fuel rail 460 from leaking out.

The injector 410 includes a fuel channel 420, which extends from the upstream end 414 to the downstream end 415 and generally defines the longitudinal axis 411 of the injector 410. A check valve 422 is located in the upstream end of the channel 420, proximate to the upstream end 414 of the injector 410. The valve 422 includes a plunger 424, a seat 430, a biasing member 440, which biases the plunger 424 toward the seat 430, and a guide 450. The plunger 424 includes a stem 426, which reciprocates in a central opening 452 in the guide 450 along the longitudinal axis 411. The plunger 424 also includes a generally bulbous head 428 connected to the upstream end of the stem 426. The head 428 includes a generally flat annular ledge 429 against which an upstream end 442 of the biasing member 440, preferably a helical spring, is biased. A downstream end 444 of the biasing member 440 is biased against the guide 450. Although a helical spring is preferred, those skilled in the art will recognize that other biasing members can be used.

The seat 430 includes a longitudinal seat channel 432, which extends therethrough along the longitudinal axis 411. The seat 430 also includes a generally annular beveled seating surface 434, which extends downstream and away from the longitudinal axis 411. In an uninstalled condition (not shown), the head 428 is biased by the biasing member 440 against the seating surface 434, shutting off flow from the seat channel 432 downstream to the fuel channel 420. A second check valve 470 is located in the opening 462 in the fuel rail 460. The valve 470 includes a plunger 472, a seat 480, a biasing member 490, which biases the plunger 472 toward the seat 480, and a guide 493. The plunger 472 includes a stem 476, which reciprocates in a central opening 494 in the guide 493 along the longitudinal axis 411. The plunger 472 also includes a generally bulbous head 474 connected to the upstream end of the stem 476. The head 474 includes a generally flat annular ledge 475 against which an upstream end 491 of the biasing member 490, preferably a helical spring, is biased. A downstream end 492 of the biasing member 490 is biased against the guide 493. Although a helical spring is preferred, those skilled in the art will recognize that other biasing members can be used.

The seat 480 includes a longitudinal seat channel 482, which extends therethrough along the longitudinal axis 411. The seat 480 also includes a generally annular beveled seating surface 484, which extends downstream and away from the longitudinal axis 411. In an uninstalled condition (not shown), the head 478 is biased by the biasing member 490 against the seating surface 484, shutting off flow from the seat channel 482 downstream of the valve 470.

In an installed but unpressurized condition, the head 428 of the first valve 422 remains biased against the seating surface 434 and the head 472 of the second valve 470 remains biased against the seating surface 484, preventing fuel in the fuel rail 460 from entering the fuel injector 410. However, when the fuel rail channel 466 is pressurized with fuel, the pressurized fuel forces against the head 472, forcing the head 472 from the valve seat 484, allowing the fuel to flow past the second valve 470 to the first valve 422.

The pressurized fuel which has passed through the valve 470 forces against the head 428 and overcomes the force of the biasing member 440, separating the head 428 from the seating surface 434. In this condition, the fuel channel 420 is in fluid communication with the fuel rail channel 466, allowing pressurized fuel in the fuel rail channel 466 to flow through the seat channel 482, through a plurality of radially spaced openings 495 in the guide 493, through the seat channel 422, through a plurality of radially spaced openings 454 in the guide 450, and to the fuel channel 420 for injection.

When the pressure of the fuel in the fuel channel 466 decreases to a force less than the force exerted either by the biasing member 440 against the plunger 424 and by the biasing member 490 against the plunger 472, the biasing member 440 biases the plunger 424, and thus the head 428, against the seating surface 434 of the valve seat 430, preventing any fuel in the injector 410 from leaking from the upstream end 414 of the injector 410 and the biasing member 490 biases the plunger 472, and thus the head 478, against the seating surface 484 of the valve seat 480, preventing any fuel in the fuel rail channel 466 from leaking out of the fuel rail 460. Preferably, the spring constant for the biasing members 440, 490 are generally the same, although those skilled in the art will recognize that the spring constants for the biasing members 440, 490 can be different.

Figure 9:
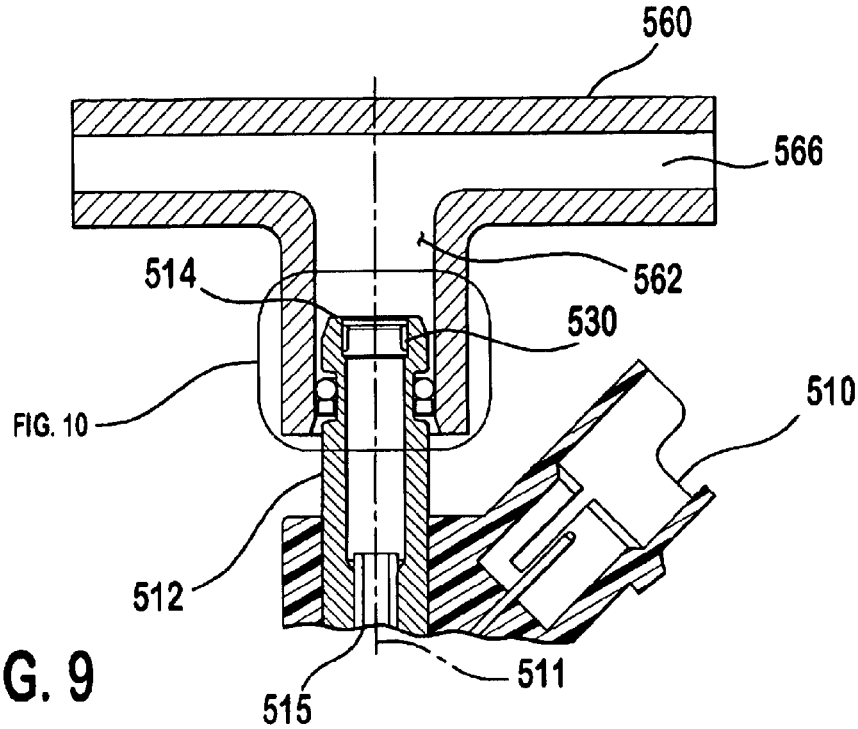
FIG. 9 is a side view, in section, of a fuel injector connected to a fuel rail in accordance with a fifth embodiment of the present invention.
Figure 10:
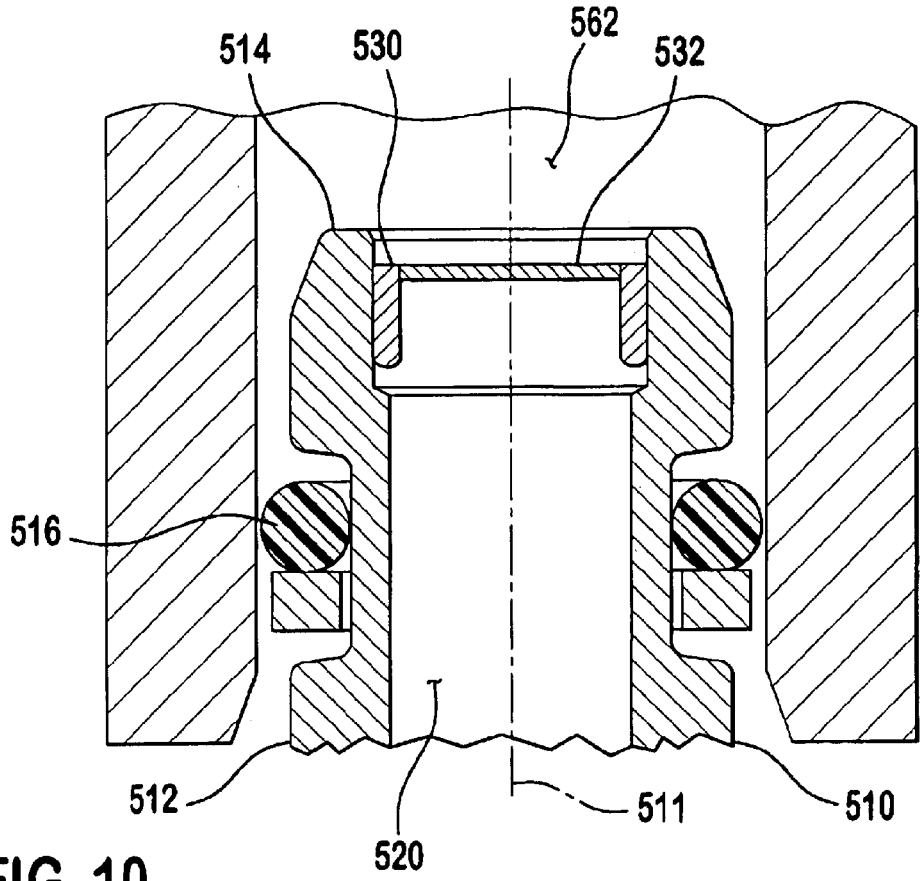
FIG. 10 is an enlarged view of the fuel injector connected to the fuel rail as shown in FIG. 9.

A fifth embodiment, shown in FIGS. 9 and 10, discloses a fuel injector 510 which uses a one-way flow inhibitor 530 composed of a semi-permeable membrane 532 which allows fuel flow in the downstream direction, but prevents flow in the upstream direction.

The fuel injector 510 includes a longitudinal axis 511 extending therethrough. The fuel injector 510 also includes a neck 512 at an upstream end 514 of the fuel injector 510, which is sized to fit into an opening 562 in the fuel rail 560. A downstream end 515 of the injector 510 is located at a distal end of the injector 510 from the upstream end 514. An o-ring 516 is located on an outer perimeter of the neck 512 such that when the fuel injector 510 is inserted into the fuel rail 560, the o-ring 516 seals any space between the outer perimeter of the neck 512 and the opening 562, preventing fuel in the fuel rail 560 from leaking out.

The injector 510 includes a fuel channel 520, which extends from the upstream end 514 to the downstream end 515 and generally defines the longitudinal axis 511 of the injector 510. A one-way flow inhibitor 530 is located in the upstream end of the channel 520, proximate to the upstream end 514 of the injector 510. The one-way flow inhibitor 530 includes the membrane 532, which extends across the fuel channel 520. The membrane 532 is connected to the side wall of the fuel channel 520 by a seal 534, which prevents fuel from leaking out of the injector 510 between the membrane 532 and the side wall of the fuel channel 520. Preferably, the membrane 532 is constructed from Gore-Tex® or other similar material that permits one-way flow, from upstream to downstream, only.

In an installed and pressurized condition, pressurized fuel from the fuel channel 566 is forced upon the upstream side of the membrane 532. The fuel diffuses through the membrane 532 to the fuel channel 520 for injection. When the injector 510 is removed from the fuel rail 560, fuel in the injector 510 is prevented from leaking out the membrane 532 due to the membrane's one-way flow characteristics.

Figure 11:
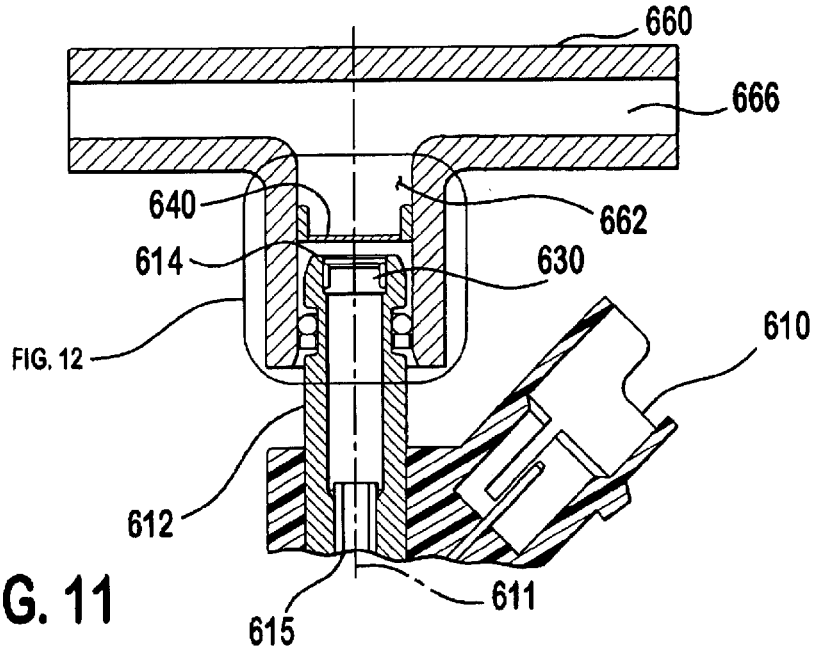
FIG. 11 is a side view, in section, of a fuel injector connected to a fuel rail in accordance with a sixth embodiment of the present invention.
Figure 12:
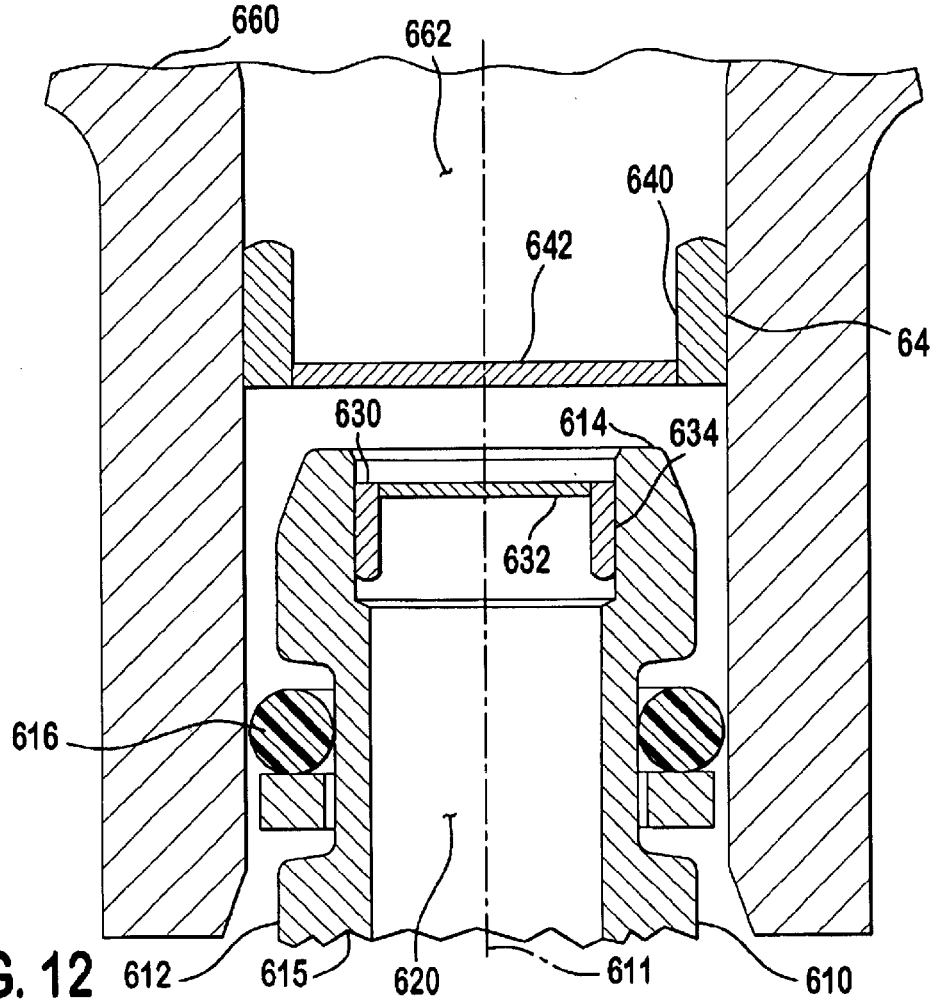
FIG. 12 is an enlarged view of the fuel injector connected to the fuel rail as shown in FIG. 11.

A sixth embodiment, shown in FIGS. 11 and 12, discloses a fuel injector 610 which uses a one-way flow inhibitor 630 composed of a semi-permeable membrane 632 which allows fuel flow in the downstream direction, but prevents flow in the upstream direction. The fuel rail 660 includes a semi-permeable membrane 642 located in a fuel opening 662 which restricts unpressurized flow of fuel from a fuel channel 666.

The fuel injector 610 is preferably the same injector as the injector 510 described in the fifth embodiment above. The fuel injector 610 includes a longitudinal axis 611 extending therethrough. The fuel injector 610 also includes a neck 612 at an upstream end 614 of the fuel injector 610, which is sized to fit into the opening 662 in the fuel rail 660. A downstream end 615 of the injector 610 is located at a distal end of the injector 610 from the upstream end 614. An o-ring 616 is located on an outer perimeter of the neck 612 such that, when the fuel injector 610 is inserted into the fuel rail 660, the o-ring 616 seals any space between the outer perimeter of the neck 612 and the opening 662, preventing fuel in the fuel rail 660 from leaking out.

The injector 610 includes a fuel channel 620, which extends from the upstream end 614 to the downstream end 615 and generally defines the longitudinal axis 611 of the injector 610. A one-way flow inhibitor 630 is located in the upstream end of the channel 620, proximate to the upstream end 614 of the injector 610. The one-way flow inhibitor 630 includes a membrane 632, which extends across the fuel channel 620. The membrane 632 is connected to the side wall of the fuel channel 620 by a seal 634 which prevents fuel from leaking out of the injector 610 between the membrane 632 and the side wall of the fuel channel 620. Preferably, the membrane 632 is constructed from Gore-Tex® or other similar material that permits one-way flow only.

A one-way flow inhibitor 640 is located in the opening 662 in the fuel rail 660 and includes a membrane 642, which extends across the opening 662. The membrane 642 is connected to the side wall of the opening 662 by a seal 644 which prevents fuel from leaking out of the fuel rail 660 between the membrane 642 and the side wall of the opening 662. Preferably, the membrane 642 is constructed from Gore-Tex® or other similar material and has a relatively high "wicking factor" which prevents unpressurized fuel from leaking through the membrane 642 in a relatively short amount of time, but does not sufficiently restrict fuel flow to the injector 610. It is anticipated that the membrane 642 will leak fuel over a relatively long period of time, but will be able to retain fuel within the fuel rail channel 666 over a period of time required to service the fuel system.

In an installed and pressurized condition, pressurized fuel from the fuel channel 666 is forced upon the upstream side of the membrane 642. The fuel diffuses through the membrane 642 to the fuel injector 610, where the pressurized fuel is forced upon the upstream side of the membrane 632. The fuel diffuses through the membrane 632 to the fuel channel 620 for injection. When the injector 610 is removed from the fuel rail 660, fuel in the injector 610 is prevented from leaking out the membrane 632 due to the membrane's one-way flow characteristics. As discussed above, the unpressurized fuel in the fuel rail 660 will be retained in the fuel rail 660 by the membrane 642 for a sufficient time to service the fuel system and reinstall the injector 610 in the fuel rail 660.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined.

What is claimed is:

1. A fuel injector comprising:

a neck at an upstream end;

a body surrounding an aperture to receive an electrical connector, the electrical connector is adapted to transmit electrical signals;

a downstream end located at a distal end from the upstream end;

a fuel channel extending from the upstream end to the downstream end and defining a substantially longitudinal axis; and a check valve located in the fuel channel proximate the upstream end, wherein the check valve includes a plunger, a seat, a biasing member biasing the plunger toward the seat, and a guide member having an opening guiding the plunger along the longitudinal axis, the opening having a cross-sectional area between upstream and downstream ends of the guide being greater than a cross-sectional area of the plunger.

2. The fuel injector of claim 1 wherein the plunger comprises a stem reciprocally mounted in a central opening in the guide along the longitudinal axis and a generally bulbous head connected to an upstream end of the stem.

3. The fuel injector of claim 2 wherein an end of the generally bulbous head comprises a generally flat annular ledge against which an end of the biasing member is biased.

4. The fuel injector of claim 2 wherein a downstream end of the generally bulbous head of the check valve comprises a generally flat annular ledge against which an upstream end of the biasing member of the check valve is biased.

5. The fuel injector of claim 1 wherein a downstream end of the biasing member is biased against the guide.

6. The fuel injector of claim 1 wherein the biasing member is a helical spring.

7. The fuel injector of claim 1 wherein the seat comprises a longitudinal seat channel extending along the longitudinal axis and a generally annular beveled seating surface.

8. The fuel injector of claim 7 wherein the generally bulbous head is biased by the biasing member toward the seating surface.

9. The fuel injector of claim 1, wherein the neck fits into an opening defined by a housing.

10. A fuel injector comprising:

a neck at an upstream end;

a downstream end located at a distal end from the upstream end;

a fuel channel extending from the upstream end to the downstream end and defining a substantially longitudinal axis; and a check valve located in the fuel channel proximate the upstream end, the neck fitting into an opening defined by a housings and further comprising a projection from the housing biasing a plunger of the check valve toward a guide of the check valve.

11. The fuel injector of claim 9 wherein the housing comprises a one-way flow inhibitor located along the substantially longitudinal axis.

12. The fuel injector of claim 1, further comprising an o-ring located on an outer perimeter of the neck.

13. The fuel injector of claim 1, wherein the check valve comprises a membrane extending across the fuel channel and a seal connecting the membrane to a side wall of the fuel channel.

14. The fuel injector of claim 13 wherein the membrane allows fuel flow in a downstream direction and prevents fuel flow in an upstream direction.

15. A method of reducing leaks when a fuel injector is removed from a housing comprising:

providing a fuel channel extending along a longitudinal axis in the fuel injector communicating with an opening in the housing, wherein the fuel channel of the fuel injector has a first check valve with a first plunger disposed in an opening formed in a guide member and a first seat, the opening having a cross sectional area between upstream and downstream ends of the guide member greater than a cross sectional area of the plunger;

removing the fuel injector from the housing;

biasing the first plunger against the first seat; and substantially retaining any unpressurized fuel in the fuel injector.

16. A method of reducing leaks when a fuel injector is removed from a housing comprising:

providing a fuel channel in the fuel injector communicating with an opening in the housing, wherein the fuel channel of the fuel injector has a first check valve with a first plunger and a first seat, the providing comprises engaging a projection from the housing with the first plunger, and forcing the first plunger away from the first seat;

removing the fuel injector from the housing;

biasing the first plunger against the first seat; and substantially retaining any unpressurized fuel in the fuel injector.

17. The method of claim 16 wherein the removing comprises:

relieving any force against the first plunger.

18. The method of claim 15 further comprising:

furnishing a second check valve within the housing, the second check valve having a second plunger and a second seat;

forcing the second plunger against the second seat.

19. The method of claim 18 further comprising:

substantially retaining fuel in the housing.

20. The method of claim 18 wherein the furnishing comprises:

protruding a projection from at least one of the first plunger and the second plunger;

engaging the projection with the other of the first plunger and the second plunger.

* * * * *